US005673830A

United States Patent [19]

Matthews

[11] Patent Number: 5,673,830

[45] Date of Patent: Oct. 7, 1997

[54] BELT SUPPORTED PNEUMATIC NAIL GUN HOLDER

[76] Inventor: Arthur T. Matthews, 430 Glenaada La., Santa Cruz, Calif. 95062

[21] Appl. No.: 568,945

[22] Filed: Dec. 7, 1995

[51] Int. Cl.[6] ..... A45F 5/00

[52] U.S. Cl. ..... 224/268; 224/673; 224/251; 224/270; 224/272; 224/904; D3/228

[58] Field of Search ..... 224/904, 197, 224/198, 619, 660, 665, 673, 676, 677, 678, 679, 248, 251, 268, 270, 272, 234; D3/228

[56] References Cited

U.S. PATENT DOCUMENTS

| | | | |
|---|---|---|---|
| 757,987 | 4/1904 | Wiles | 224/268 |
| 1,463,977 | 8/1923 | Smith | 224/270 |
| 2,651,441 | 9/1953 | Rau et al. | 224/268 |
| 2,753,100 | 7/1956 | Montgomery | 224/268 |
| 3,882,914 | 5/1975 | Strutz | 224/619 |
| 4,106,679 | 8/1978 | Hillinger | 224/197 |
| 4,319,704 | 3/1982 | Rosen | 224/270 |
| 4,714,184 | 12/1987 | Young et al. | 224/678 |
| 4,936,499 | 6/1990 | Gulley | 224/904 |
| 5,052,603 | 10/1991 | Spina | 224/904 |
| 5,195,667 | 3/1993 | Gallant | 224/673 |
| 5,511,706 | 4/1996 | Hendrickson | 224/268 |

*Primary Examiner*—Henry J. Recla
*Assistant Examiner*—Gregory M. Vidovich
*Attorney, Agent, or Firm*—Jeffrey A. Hall

[57] ABSTRACT

A belt supported tool holder for operably securing a tool onto a belt, comprising: a first support element having slots for adjustably positioning the first support element on a belt. The first support element includes a flat planar front surface and a flat planar rear surface. A mounting plate element is fixably secured to the first support element and includes a substantially planar upper surface and a substantially planar lower surface. Screws, bolts, rivets or other fastening elements are used for securing the mounting plate element to the first support element. A hook shaped retaining member is secured to the mounting plate element and a back support element is fixably secured to the flat planar rear surface of the first support element and to the mounting plate element. A detachable hook is provided for attachment to the tool and to the hook shaped retaining member.

19 Claims, 2 Drawing Sheets

BELT SUPPORTED PNEUMATIC NAIL GUN HOLDER

BACKGROUND OF THE INVENTION

1. Field of Invention

This invention relates to tool holders, and particularly to belt supported tool holders and holsters for supporting various tools such as pneumatic framing guns, pneumatic finish guns, cordless drill tools, saws, jig saws, and paint guns.

2. Description of the Related Art

Various tool holders and apparatus have been proposed and implemented to effect holding and supporting tools and other implements on belts. In general, such belt supported holders have been restricted to holding and carrying only specific tools and have been severely limited by being useful for only smaller, lighter tools such as hammers and saws. Other holders require cumbersome hand movements to insert the tool and/or release the tool from the holder. In many instances, a two-hand operation is required to remove the tool from the holder. Such limitations have undoubtedly been a reason such holder and holsters have not received widespread acceptance.

There is a need for a belt supported tool holder which can support tools such as pneumatic nail gun, pneumatic finish gun, paint guns, and the like, which provides a strong support means for holding and supporting such tools, which is easy to insert and remove the tool from the holder, and which may be used conveniently and efficiently with a wide variety of tools.

Accordingly, it is the primary object of this invention to provide a belt supported tool holder which provides a strong, convenient, easy to use tool holding means which is extremely reliable, easy to load and unload, adjustable, and inexpensive to clean, use, and manufacture.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a belt supported tool holder for operably securing a tool onto a belt is provided, comprising: a first support element including means for adjustably positioning the first support element on a belt. The first support element having a flat planar front surface and a flat planar rear surface. A mounting plate element is fixably secured to the first support element; the mounting plate element having a substantially planar upper surface and a substantially planar lower surface. Means are provided for securing the mounting plate element to the first support element. A hook shaped retaining member is secured to the mounting plate element and a back support element is fixably secured to the flat planar rear surface of the first support element and to the mounting plate element. A rear support element is rigidly secured to the flat planar rear surface of the first support element; and means for removably securing the tool onto the hook shaped retaining member are provided The tool holder may be sized to accommodate a wide variety of tools such as pneumatic nail guns, pneumatic finishing guns, drills, saws, paint guns, and the like. Preferably the first support element is composed of leather and the mounting plate element composed of metal. Means for securing the mounting plate element to the first support element may comprise screws, bolts, rivets or other fastening means. The hook shaped retaining element is preferably composed of metal and is secured to the mounting plate element by screws, bolts, rivets or other fastening means. The back support element is preferably composed of metal and affixed to the first support element by screws, bolts or rivets. The rear support element is preferably composed of leather and sewn onto the first support element.

Means for removably securing the tool onto the hook shaped retaining member preferably comprises a detachable L-shaped bracket hook means including means for detachably securing the L-shaped bracket hook means to the hook shaped retaining member and means for detachably securing the L-shaped bracket hook means to a tool, such a pneumatic nail gun, drill, saw, or the like.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided a belt supported tool holder for operably securing a tool onto a belt, comprising: a first support element including means for adjustably positioning the first support element on a belt. The first support element having a flat planar front surface and a flat planar rear surface. A mounting plate element being fixably secured to the first support element; the mounting plate element having a substantially planar upper surface and a substantially planar lower surface. Means for securing the mounting plate element to the first support element are provided. A hook shaped retaining member is operably secured to the mounting plate element. A back support element is fixably secured to the flat planar rear surface of the first support element and to mounting plate element. A rear support element is rigidly secured to the flat planar rear surface of the first support element, and, means are provided for removably securing the tool onto the hook shaped retaining member.

Figure 1:
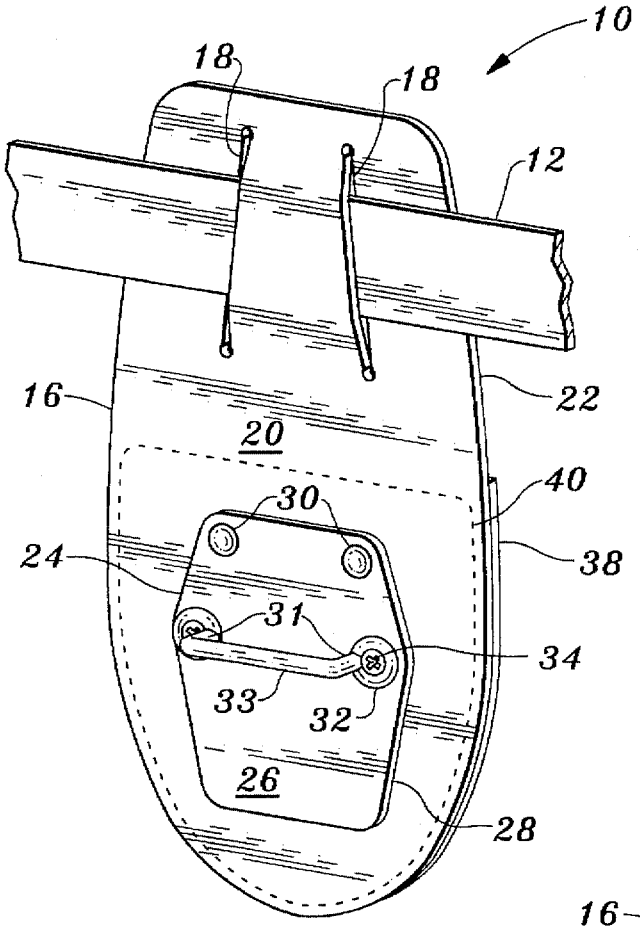
FIG. 1 is a front perspective view of a belt supported tool holder, according to the invention.

In FIG. 1, the tool holder 10 is shown with belt 12 placed in slots 18. Tool holder 10, in the preferred embodiment of the invention, includes a first support element 16 including means for adjustably positioning first support element 16 on belt 12. Preferably the means for adjustably securing holder 10 on belt 11 are provided by slots or channels 18 operably positioned in first support element 16. First support element 16 preferably has a flat substantially planar front surface 20 and a flat substantially planar rear surface 22. In the preferred embodiment, first support element 16 is composed of leather, however, in alternative embodiments other durable, resilient materials may be used such as plastic, rubber, composite, or the like.

A mounting plate element, best seen in FIG. 1, is fixedly secured to first support element 16 by securing means, preferably rivets 30, however, screws, bolts, or other fastening means may be used as well. Mounting plate 24 is preferably composed of metal and includes a substantially planar upper surface 26 and substantially planar lower surface 28. Mounting plate 24 may be configured in any geometric shape, however, shield shape, oblong, or rectangular configurations are preferred.

A substantially hook shaped retaining member 32 is operably secured to mounting plate 24 preferably by screws 34, however, rivets, bolts, or other mechanical fastening means may also be used. Retaining member 32 preferably includes a pair of L-shaped legs 31 operably linked to a substantially horizontal portion 33. In this embodiment screws 34 are fastened to legs 31 holding retaining member 32 to mounting plate 24. Alternatively, retaining member 32 may be J-shaped or configured as a hook. Preferably, retaining member 32 is composed of a metal, however, other durable resilient materials may be used such as composites.

Figure 2:
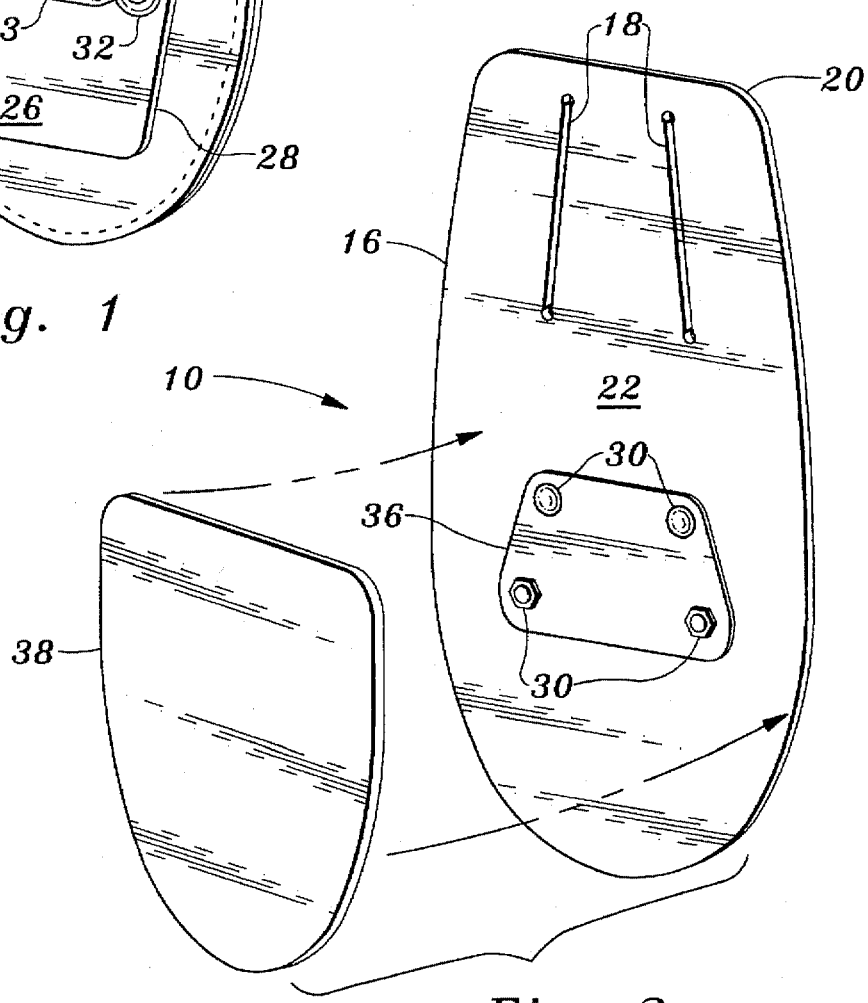
FIG. 2 is a rear view of such tool holder with the rear support element detached, according to the invention.
Figure 4:
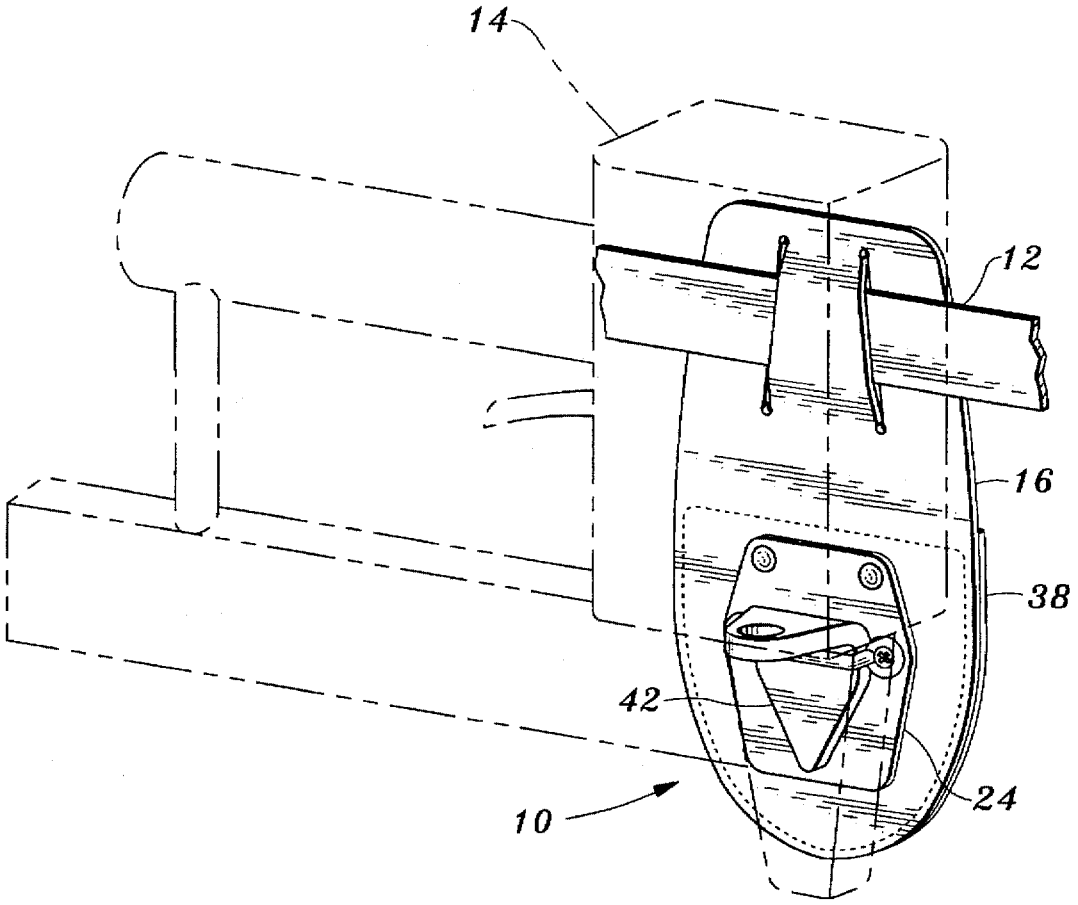
FIG. 4 is a perspective view showing the L-shaped bracket hook secured in the retaining member, according to the invention.

Referring now to FIG. 2, a back support element is shown fixably secured to the flat planar rear surface 22 of first support element 16 and to mounting plate 24. Back support element 36 is preferably secured to first support element and 16 and mounting plate 24 by rivets 34, however, screws, bolts, or other fastening means may also be used. Back support element 36 is preferably composed of a metal, such as stainless steel, and provides support for mounting plate 24 and first support element 16. Also seen in FIG. 2 is rear support element 38 which is rigidly secured to flat planar rear surface 22 of first support element 16 by threaded stitches which may be leather, cord, wire, string, thread, or the like. Alternatively, rear support element 38 may be riveted, screwed, or otherwise fastened to first support element 16.

Figure 3:
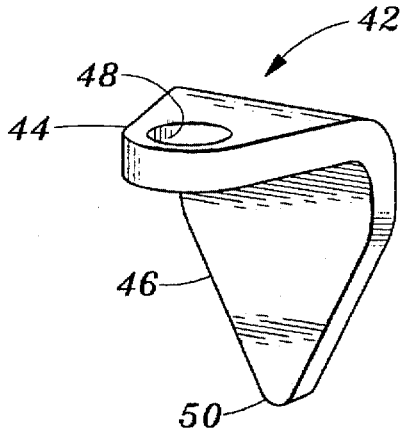
FIG. 3, is a perspective view of an L-shaped bracket hook for removably securing a tool onto the retaining member, according to the invention.

Referring now to FIG. 3, means for removably securing a tool onto retaining member 32 is shown as bracket hook 42 which is preferably provided as a detachable L-shaped bracket hook with first leg 44 and second leg 46. Bracket hook 42 preferably is provided with aperture 48 for securing to a tool 14 such as a pneumatic nail gun, pneumatic finish gun, paint gun or the like. However, for other tools such as saws or drills bracket hook 42 may be provided without aperture 48. The shape, size, and configuration of bracket hook 42 may be changed to accommodate a particular tool. This allows for tool holder 10 to be used with a wide variety of tools. Hook bracket 42 is preferably composed of metal, and as shown, configured with pointed end 50, however, it may be otherwise.

In operation and use tool holder is very easy, convenient, and reliable to use. First support means 16 is simply secured to belt 11 by threading belt 11 through slots 18 in first support element 16 and adjusted into a desired position. Hook bracket 42 is then secured to a tool such as a pneumatic nail gun and then hooked to retaining member 32 on mounting plate element 24. This is especially useful for holding tools during work, or when the user simply wishes to have his or her hands free and a convenient place to set the tool.

As is evident from the above description, a wide variety of designs or styles of tool holder may be fashioned from the present invention. For example, various shapes of bracket hook 42 may be provided depending upon the particular application. Mounting plate 24 may be provided in a number of different shapes and sizes, and first support element 16 provided in an number of different sizes and shapes depending upon the tool with which it will be used.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A belt supported pneumatic nail gun holder for operably securing a pneumatic nail gun onto a belt, comprising:

a first support element including means for adjustably positioning said first support element on a belt; said first support element having a flat planar front surface and a flat planar rear surface;

a mounting plate element being fixably secured to said front surface of said first support element; said mounting plate element having a substantially planar upper surface and a substantially planar lower surface;

means for securing said mounting plate element to said first support element such that a substantial portion of said planar lower; surface contacts said front surface of said first support element.

a hook shaped retaining member secured to said upper surface of said mounting plate element, said hook shaped retaining member having a pair of L-shaped legs operably linked to a horizontal portion of the hook shaped retaining member;

a back support element being fixably secured to said flat, planar rear surface of said first support element and to said mounting plate element;

a rear support element being rigidly secured to said flat planar rear surface of said first support element; and, means for removably securing said pneumatic nail gun onto said hook shaped retaining member.

2. The pneumatic nail gun holder of claim 1, wherein said means for adjustably positioning said first support element on a belt comprises a pair of spaced slits in said first support element adapted to receive and secure a belt therein.

3. The pneumatic nail gun holder of claim 1, wherein said first support element is composed of leather.

4. The pneumatic nail gun holder of claim 1, wherein said means for securing said mounting plate element to said first support element comprises a plurality of screws.

5. The pneumatic nail gun holder of claim 1, wherein said means for securing said mounting plate element to said first support element comprises a plurality of bolts.

6. The pneumatic nail gun holder of claim 1, wherein said means for securing said mounting plate element to said first support element comprises a plurality of rivets.

7. The pneumatic nail gun holder of claim 1, wherein said mounting plate element is composed of metal.

8. The pneumatic nail gun holder of claim 1, wherein said hook shaped retaining member is secured to said mounting plate element by screws.

9. The pneumatic nail gun holder of claim 1, wherein said hook shaped retaining member is secured to said mounting plate element by bolts.

10. The pneumatic nail gun holder of claim 1, wherein said hook shaped retaining member is secured to said mounting plate element by rivets.

11. The pneumatic nail gun holder of claim 1, wherein said legs of said hook shaped retaining member being fastened to said mounting plate by a pair of screws.

12. The pneumatic nail gun holder of claim 1, wherein said hook shaped retaining member is composed of metal.

13. The pneumatic nail gun holder of claim 1, wherein said back support element is fixably secured to said first support element by screws.

14. The pneumatic nail gun holder of claim 1, wherein said back support element is fixably secured to said first support element by bolts.

15. The pneumatic nail gun holder of claim 1, wherein said back support element is fixably secured to said first support element by rivets.

16. The pneumatic nail gun holder of claim 1, wherein said back support element is composed of metal.

17. The pneumatic nail gun holder of claim 1, wherein said back support element is composed of stainless steel.

18. The pneumatic nail gun holder of claim 1, wherein said rear support element is sewn onto said first support element.

19. The pneumatic nail gun holder of claim 1, wherein said means for removably securing said pneumatic nail gun onto said hook shaped retaining member comprises a detachable L-shaped bracket hook.

* * * * *